US005613842A

United States Patent [19]

Alfano et al.

[11] Patent Number: 5,613,842

[45] Date of Patent: Mar. 25, 1997

[54] HERMETICALLY SEALED MOTOR COMPRESSOR UNIT WITH A SPRING BIASED MUFFLER

[75] Inventors: Biagio Alfano, Milan; Edoardo Biscaldi, Saronno, both of Italy

[73] Assignee: Necchi Compressori s.r.l., Pavia, Italy

[21] Appl. No.: 553,067

[22] Filed: Nov. 3, 1995

[30] Foreign Application Priority Data

Nov. 3, 1994 [IT] Italy ..... PV94A0014

[51] Int. Cl.[6] ..... F04B 39/12

[52] U.S. Cl. ..... 417/312; 181/403

[58] Field of Search ..... 417/312, 902; 181/229, 403; 62/296

[56] References Cited

U.S. PATENT DOCUMENTS 4,755,108 7/1988 Todescat et al. ..... 417/312

5,207,564 5/1993 Fritchman ..... 181/403

FOREIGN PATENT DOCUMENTS 195486 9/1986 European Pat. Off. ..... 417/312

78774 3/1990 Japan ..... 417/312

81967 3/1990 Japan ..... 417/312

*Primary Examiner*—Timothy Thorpe

*Assistant Examiner*—Roland G. McAndrews, Jr.

*Attorney, Agent, or Firm*—Watson Cole Stevens Davis, P.L.L.C.

[57] ABSTRACT

A sealed motor-compressor unit having a suction side muffler directly attached to the cylinder head by a niche in the cylinder head which receives the muffler. A "U" shaped spring has two legs contacting sidewalls of the niche and a bight portion which contacts and biases the muffler.

4 Claims, 2 Drawing Sheets

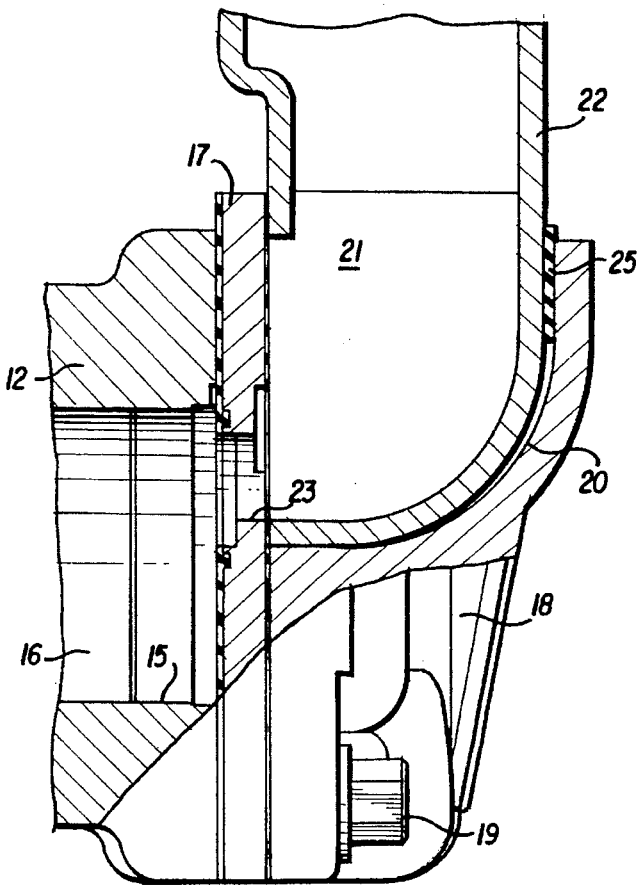
FIG. 2
FIG. 3
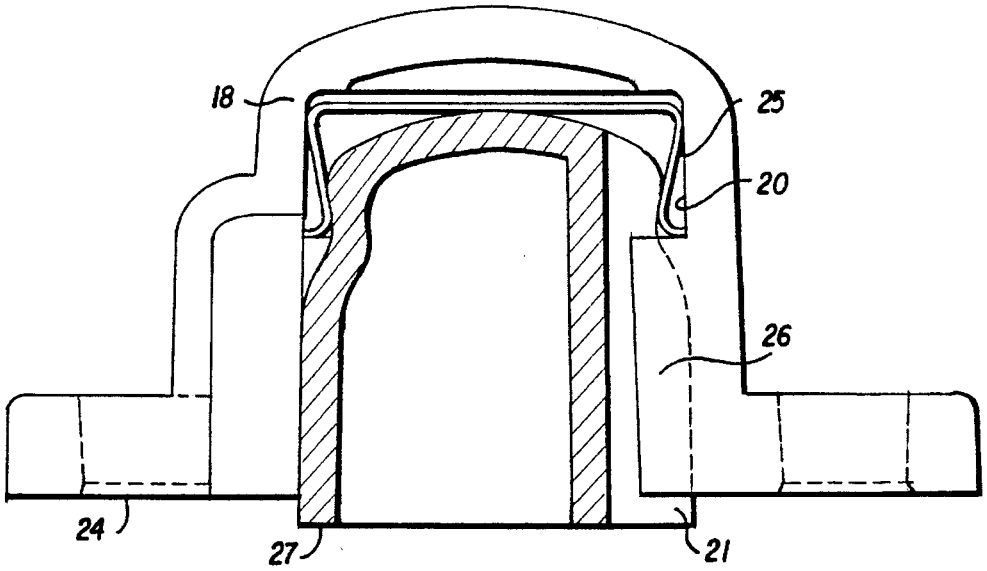

HERMETICALLY SEALED MOTOR COMPRESSOR UNIT WITH A SPRING BIASED MUFFLER

INTRODUCTION

The present invention relates to a reciprocating hermetically sealed motor compressor unit comprising a driving electric motor, a body to which said motor is fixed, a cylinder formed in said body and in which a piston reciprocates, a valve plate positioned at one end of said cylinder, a head which fixes said valve plate to said cylinder and a muffler on the suction portion through which the refrigerant gas is sucked into the cylinder.

BACKGROUND OF THE INVENTION

In known reciprocating motor compressors, the refrigerant gas, which arrives from a vaporizer in the surrounding shell, passes through a muffler and into a suction chamber which is formed in the head, and from there, through a valve plate it is sucked into the cylinder.

From the cylinder the compressed gas passes through a discharge port in the valve plate and arrives in a delivery chamber, also formed in the head, and from there the gas is sent to a condenser.

In compressing the gas, work is required, thus there is generation of heat which is partially transmitted to the head by the gas in the delivery chamber. Since the delivery chamber is contiguous to the suction chamber, this chamber also gets hot, thus the gas passing through the suction muffler absorbs heat before entering the cylinder. According to known physical laws, the heating of a gas causes an increase of volume, thus the refrigerant gas, if it absorbs heat in the suction chamber, increases its volume and, as a consequence, the density of gas sucked into the cylinder is lower than the density of gas that would be sucked into the cylinder if the gas were at a lower temperature.

The foregoing causes a smaller amount of inlet refrigerant gas to be introduced into the refrigerant apparatus in the delivery phase and this causes a loss of efficiency of the refrigerating cycle. In order to overcome this drawback in the present invention the suction chamber in the head has been eliminated and the muffler is fixed to be in direct communication with a suction hole formed in the valve plate. The vibrations of the compressor causes, after some time, a defective coupling of the muffler with the suction hole. Thus a certain quantity of gas, instead of being sucked into the cylinder, disperses inside the compressor shell causing decreased efficiency of the refrigerating apparatus as a smaller quantity of refrigerant gas is compressed at every cycle.

In another solution for the above problem the suction muffler, which is positioned on the valve plate, is kept in position by a screw into the cylinder.

This solution does not assure a perfect coupling between the suction hole of the valve plate and the muffler. There is a dispersion of gas and thus lower efficiency. Another drawback of this solution is an increase in noise as the defective adhesion of the muffler end with the valve plate produces noise generated by the gas flow and a loss of sound-proofing of the circuit.

It is the purpose of the present invention to overcome the above-described drawbacks.

SUMMARY OF THE INVENTION

This invention includes a reciprocating hermetically sealed motor compressor unit having a cylinder head 19 with a niche 20 for receiving an end 21 of a suction muffler 22. A spring 25, placed in the niche between the end of the muffler and the head, pushes said muffler end against a valve plate 17 when the head is fixed to its cylinder 15; this causes gas sucked into said cylinder to pass directly into the cylinder without leakage inside the compressor and as a consequence avoids decreasing performance.

The technical problem to be solved was to avoid the refrigerant gas absorbing heat in the suction phase in the cylinder and to obtain a perfect seal between the muffler with the valve plate which may increase the performance of the compressor and reduce the noise.

The solution of the technical problem is characterized by the fact that the head has a niche for receiving the muffler end in order to position the muffler end to correspond with the suction hole formed in the valve plate; biasing means are provided to keep said muffler end against said valve plate during operation of the compressor.

BRIEF DESCRIPTION OF THE DRAWINGS

Further characteristics and advantages will be apparent from the following description and from the accompanying drawings in which:

FIG. 2 is a section taken along the line 2—2 of FIG. 1, and

FIG. 3 is a section taken along the line 3—3 of FIG. 1.

DETAILED DESCRIPTION OF A PREFERRED EMBODIMENT

Figure 1:
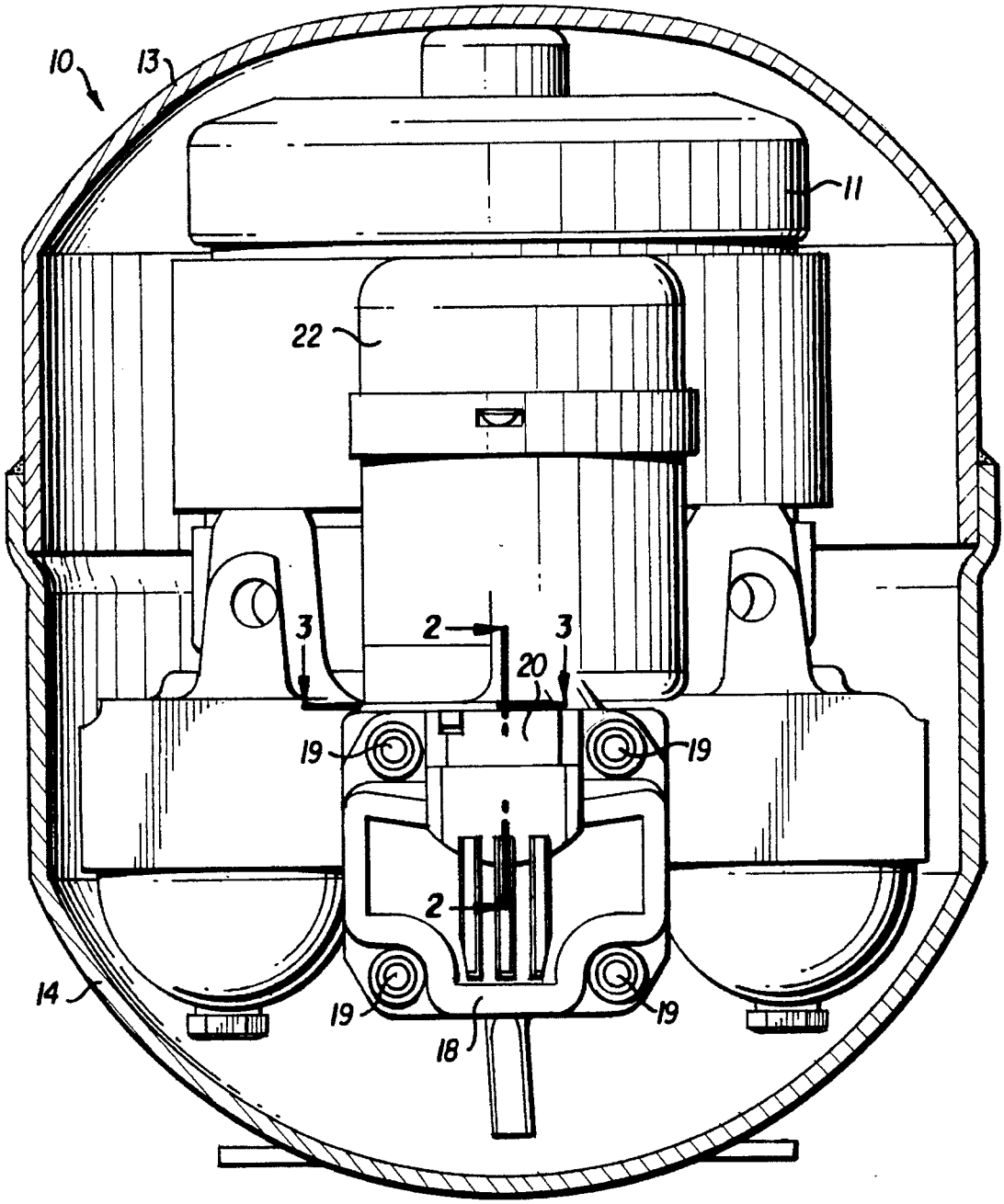
FIG. 1 is a front view of the compressor of the present invention.

With reference to FIG. 1 numeral 10 generally indicates a reciprocating hermetic motor compressor comprising a driving electric motor 11, a body 12 to which said motor 11 is fixed and an upper shell 13 and a lower shell 14 which hermetically enclose the motor compressor unit.

In the body 12 a cylinder 15 is formed (FIG. 2) in which a piston 16 reciprocates. A valve plate 17 is placed at one end of the cylinder 15 and is fixed to said cylinder by means of a head 18 fixed to the body 12 by screws 19 (FIGS. 1 and 2).

The head 18 has a niche 20 in the form of a "U" shaped body which, as shown in FIG. 1, has an upwardly facing open end for receiving the end 21 of a muffler 22 through which the refrigerant gas passes when it is sucked into the cylinder 15. The end 21 of the muffler 22 is positioned to overlie and correspond with a suction hole 23 formed in the valve plate 17.

Before the head 18 is positioned in order to fix the valve plate to the body 12, the end 21 of the muffler 22 (FIG. 3) is inserted into the niche 20 and the plane surface 27 of the muffler end 21, which comes into contact with the valve plate 17, projects in relation to the plane 24 of the head 18. This projection results because of a spring 25, placed in the niche 20, at the bottom thereof in a stop position, prevents the end of the muffler from initially positioning completely into the niche 20.

When the head 18 is fixed in its permanent position by means of the screws 19 to the end of the cylinder 15 in order to fix the valve plate 17, also the end 21 of the muffler 22, carried by the head 18, is positioned to be over the suction hole 23 of the valve plate 17.

Overcoming the resistance of the spring 25, the muffler end 21 enters completely into the niche 20 as the bolts 19 are tightened so that the plane surface 27 of said muffler end 21 forms a continuation of the plane surface 24 of the head 18 (FIG. 2).

By fixing the bolts 19 and by the action of the spring 25, a permanent coupling of the end 21 of the muffler 22 with the valve plate 17 is obtained; in fact the spring 25, when bolts 19 are tightened, pushes the muffler end 21 against the valve plate 17 while the fixing of the bolts 19 prevents the muffler 22 from moving, avoiding in this way leakage during the flow of the refrigerant gas from said muffler 22 into the cylinder 15 through the suction hole 23 formed in the valve plate 17.

The muffler 22 cannot move from the head 18 when the head is fixed by the screws 19 to the body 12 as a wall 26 of the head 18 engages the end 21 and prevents the muffler from moving upward. As shown in FIG. 3 the spring 25 has two legs which contact interior sidewalls of niche 20 and a substantially rectilinear bight portion adjacent the concave back wall of the niche. Thus as end 21 of muffler 22 pushes against this bight, it has space to deform.

The refrigerant gas enters directly into the cylinder 15 from the muffler 22, so that it cannot absorb heat and as a consequence increase its volume in the suction phase, so a higher quantity of gas is sucked into the cylinder 15, thus improving the efficiency of the refrigerating apparatus.

By the above described solution it is possible to obtain a further reduction of the noise produced by the valves, as the niche 20, being metallic, increases the sound-proofing index.

We claim:

1. A reciprocating hermetically sealed motor compressor unit comprising a driving electric motor, a body to which said motor is fixed, a cylinder formed in said body and a piston mounted for reciprocation therein, a valve plate having a suction hole, positioned at a first end of a cylinder, a head on said cylinder first end which fixes said valve plate to said cylinder, a muffler on a suction side of said piston through which the refrigerant gas is sucked into the cylinder, said head having a niche for receiving an end of said muffler to position said muffler end so as to correspond with said suction hole in said valve plate, and biasing means being provided to keep said muffler against said valve plate during operation of said compressor, said biasing means comprises a spring in said niche and positioned to push said end of the muffler against said valve plate when said head is fixed to said cylinder, said spring being "U" shaped with two legs contacting sidewalls of said niche and a bight portion spanning across said niche, said bight portion being contacted by and deformed by said muffler end.

2. A motor compressor unit of claim 1 in which a surface of said muffler end adjacent the valve plate projects beyond a plane of the head when said head is not fully in place, said projection being annulled when said head is fixed to said cylinder and said spring is deformed to push said muffler end against said valve plate.

3. The motor compressor unit of claim 1 in which said niche has a wall which engages said muffler end to maintain said muffler in place when said head is fixed to said cylinder.

4. The motor compressor unit of claim 1 in which the bight portion of said spring is substantially rectilinear and an adjacent wall of the niche is concave to afford space for deformation of said bight portion.

* * * * *